US005211282A

United States Patent [19]

Ting

[11] Patent Number: 5,211,282

[45] Date of Patent: May 18, 1993

[54] SQUEEZE SWITCH

[75] Inventor: Charles Ting, Taipei, Taiwan

[73] Assignee: American Fun & Toy Creators, Inc., Salt Point, N.Y.

[21] Appl. No.: 834,407

[22] Filed: Feb. 12, 1992

[51] Int. Cl.[5] ..... H01H 9/02

[52] U.S. Cl. ..... 200/303; 200/505; 200/292

[58] Field of Search ..... 200/303, 505, 250, 292, 200/290, 61.58 R, 81 H, 573, 293, 5 A, 43.04, 43.05, 43.07; 446/302, 484, 369, 439; 206/328, 333; 273/856, 586

[56] References Cited

U.S. PATENT DOCUMENTS

| | | | |
|---|---|---|---|
| 3,046,366 | 7/1962 | Zekendorf | 200/52 |
| 3,740,543 | 6/1973 | Franc | 446/485 |
| 4,371,593 | 2/1983 | Ramey | 429/97 |
| 4,547,635 | 10/1985 | Segan et al. | 200/52 R |
| 4,547,635 | 10/1985 | Segan et al. | 200/52 R |
| 4,697,133 | 9/1987 | Pergandis | 320/2 |
| 4,734,074 | 3/1988 | Kinberg et al. | 446/184 |
| 5,059,754 | 10/1991 | Kaicsi et al. | 200/293 |
| 5,074,820 | 12/1991 | Nakayama | 446/29 |

FOREIGN PATENT DOCUMENTS

| | | | |
|---|---|---|---|
| 2583648 | 12/1986 | United Kingdom | 273/58 |

*Primary Examiner*—Henry J. Recla
*Assistant Examiner*—David J. Walczak
*Attorney, Agent, or Firm*—Cohen, Pontani, Lieberman, Pavane

[57] ABSTRACT

The present invention is a squeeze switch device (10) for use in plush toys wherein the device housing is comprised of upper (14) and lower (16) sections secured together by protrusions (44) and slots (24) and wherein springs (62) bias the device for activation by applying a squeezing pressure to the stuffed toy in any one of a plurality of directions. A device (36) for reducing battery drain during device manufacture, storage and shipping are also disclosed.

6 Claims, 3 Drawing Sheets

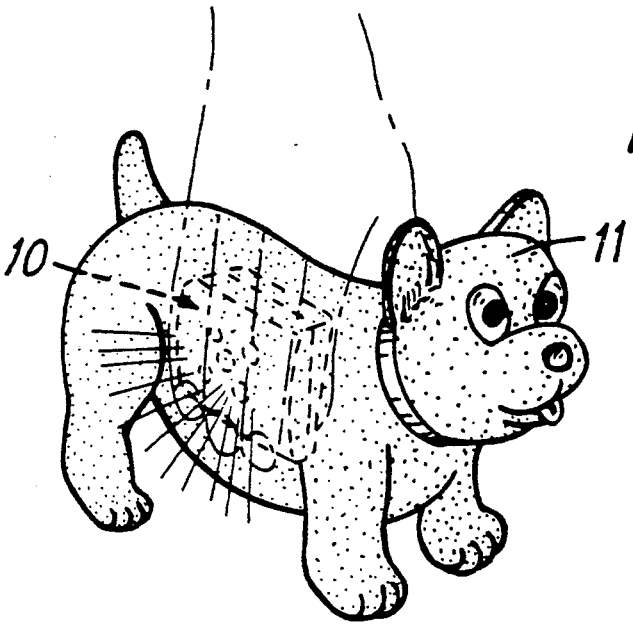
FIG. 1
FIG. 2
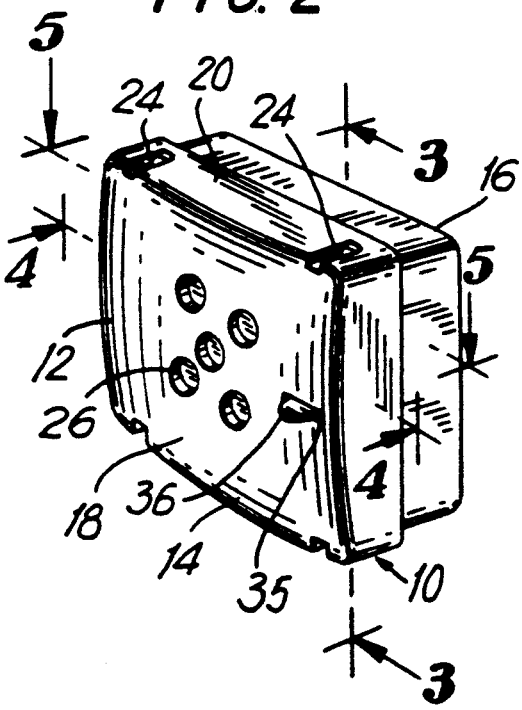
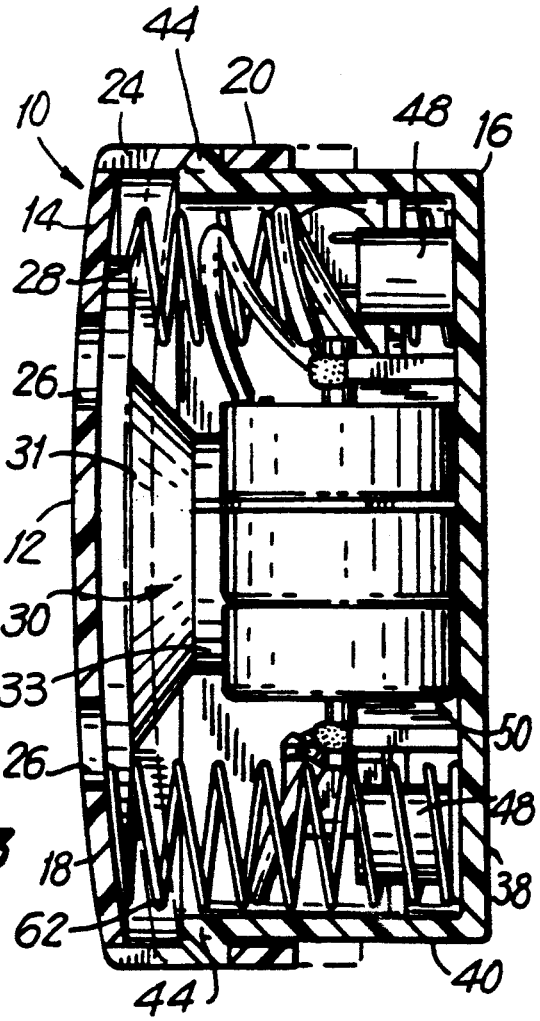
FIG. 3

SQUEEZE SWITCH

BACKGROUND OF THE INVENTION

I. Field of the Invention

This invention pertains to sound, light and/or motion generating devices and more particularly to devices activated by squeezing such that the device may be incorporated in a plush toy such as a stuffed toy animal and activated by squeezing the toy in any one of a plurality of directions. Typically, if the device is a sound generating device, when incorporated in a stuffed toy animal, the device generates a sound that is commonly associated with the appearance of the animal.

II. Background Art

Plush toys, which generate sound, light and/or motion when squeezed, are well known. Typically, the sound, light and/or motion generating mechanism comprises a batterypowered electric circuit connected to a load in combination with a switch mechanism which, when pressure is applied to the plush toy, activates the circuit. Because batteries have a finite life, typically the electric circuit is housed in a zippered pouch in the plush toy for providing battery access. However, the provision of a zippered pouch adds to the cost of the plush toy, as a zippered seam is more expensive than a stitched one.

Of course, if the plush toy is made without a zippered pouch, i.e. without battery access, the plush toy eventually loses its appeal. That is, once the battery dies, the plush toy is incapable of generating sound, light and/or motion. Therefore, in the case of such a plush toy, it is imperative that the mechanism be as inexpensive as possible.

Where, as is contemplated by the present invention, the sound, light and/or motion generating mechanism is intended to be inaccessible, it is also imperative that the battery life be maximized. The prior art devices known to applicant make no provision for unintended activation of the mechanism prior to incorporation in the plush toy. For example, once the sound, light and/or motion generating mechanism is assembled, but prior to insertion in the plush toy, such prior art devices can be activated by simply squeezing the mechanism in the proper direction. It will thus be readily apparent that inadvertent squeezing can occur during handling, storage and shipping, with the consequence that even before the mechanism is incorporated in a plush toy, the battery life may have been substantially reduced.

Another drawback in the prior art of sound, light and/or motion generating mechanisms known to applicant is that they require a squeezing pressure to be applied in a particular direction to close the switch which activates the circuit. While this is not a drawback in the case of toys wherein squeezing pressure is always applied in a predetermined direction, as in the case of the rocking horse disclosed in U.S. Pat. No. 5,074,820 wherein the switch is activated by a child sitting on the seat, it is a disadvantage in the case of hand held plush toys wherein the sound generating mechanism is hidden from view inside the toy, thus requiring the child to experiment to determine the direction in which pressure must be applied to activate the mechanism.

It is accordingly an object of the invention to provide a sound, light, or motion generating device to be incorporated in a plush toy wherein said device can be activated by applying a squeezing force to the plush toy in any one of a plurality of directions.

It is another object of the invention to provide an improved sound, light or motion generating device wherein the device is inexpensive and relatively easy to assemble.

It is still a further object of the invention to provide a sound, light, or motion generating device wherein the power supply powering the device is not accessible once the device is incorporated in a plush toy and wherein the device incorporates means for conserving battery power during manufacture, assembly and storage.

SUMMARY OF THE INVENTION

Broadly speaking, the present invention is a sound, light and/or motion generating device for use in plush toys wherein the device comprises a circuit comprising means for generating an electrical signal corresponding to sound, light and/or motion and incorporating a push switch for activating the circuit means; load means for generating said sound, light and/or motion when excited by the electrical signal; electrical conducting means for conducting the electrical signal from the circuit means to the load means; housing means for the circuit comprising two sections; means for securing the two sections together for relative movement between a first position wherein the two sections are spaced apart by a first predetermined distance and a second position wherein the sections are spaced apart by a second distance less than the first predetermined distance, the securing means comprising a plurality of slots in the sections and a plurality of protrusions on the sections and wherein the protrusions seat in the slots for movement therein during relative movement of the sections; the push switch being secured to one of the sections and the load means secured to the other of the sections for activating the push switch when the sections are in the second position; and means for biasing the two sections in the first position and for accommodating movement of the two sections to said second position when the two sections are squeezed together.

In a preferred embodiment, the biasing means comprises a pair of springs which bias the housing in the first position when the device is in its static state.

In the preferred embodiment, the load is secured to one section of the housing in alignment with the push switch for activating same when the housing sections are squeezed together.

In another preferred embodiment, the device comprises an insulating strip and the housing contains a hole positioned in close proximity to the circuit power source, such that when the strip is inserted in the hole the power source is disconnected from the circuit, thereby avoiding unintended activation and hence prolonging battery life during manufacture, storage and shipping of the device.

BRIEF DESCRIPTION OF THE DRAWINGS

FIG. 1 is a perspective view of a plush toy incorporating a squeeze switch device according to the present invention and showing a hand, in phantom, squeezing the toy;

FIG. 2 is a perspective view of a squeeze switch device in accordance with the present invention;

FIG. 3 is a cross-sectional view substantially along line 3—3 of FIG. 2;

DETAILED DESCRIPTION OF THE PREFERRED EMBODIMENT

Figure 4:
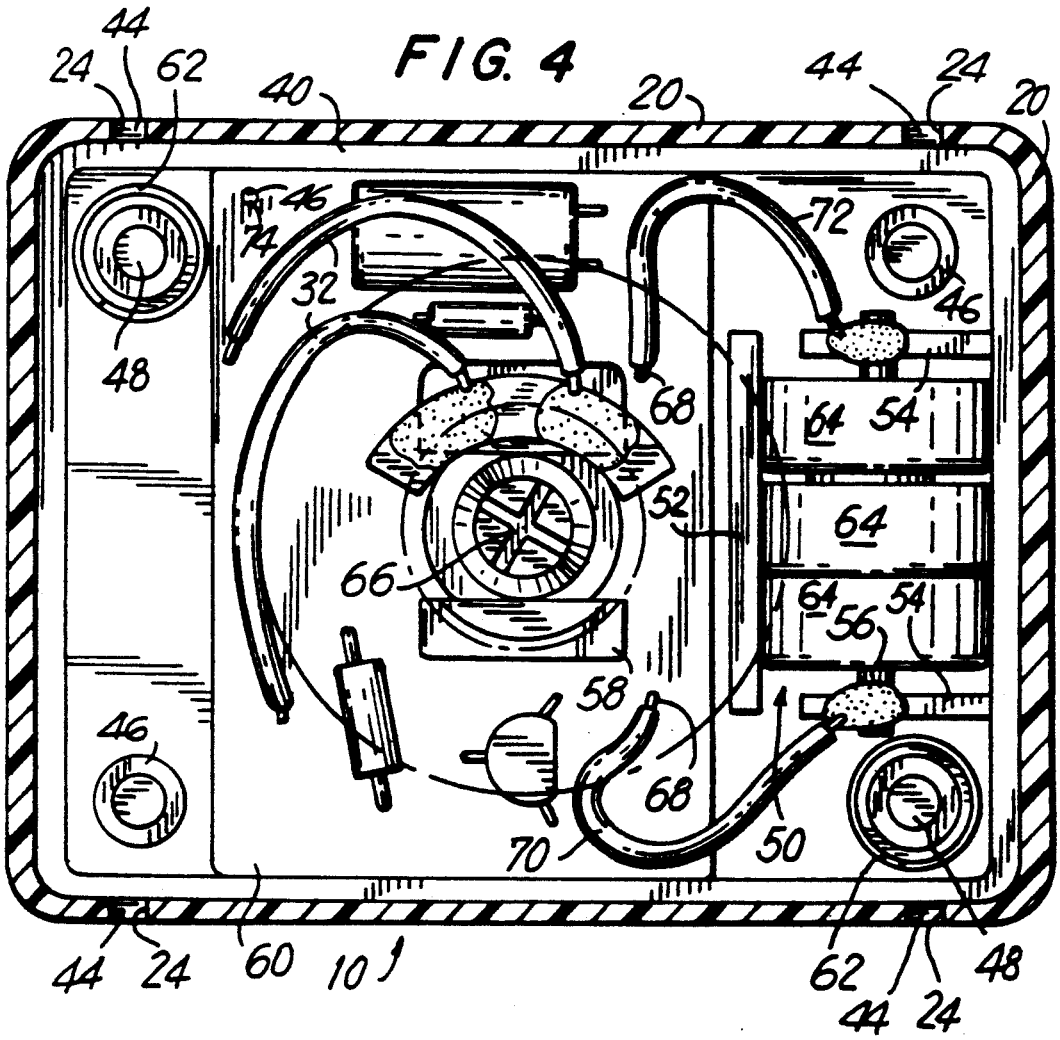
FIG. 4 is a cross-sectional view substantially along line 4—4 of FIG. 2.

Referring now to the drawings, the device in accordance with the present invention is generally designated at 10. As shown, the device comprises a rectangularly shaped casing 12 having two sections, namely, an upper section 14 and a lower section 16. The upper section 14 has a convex top wall 18 and a rectangular sidewall 20 depending from the top 18. As shown, the sides 22 of sidewall 20 include channels 24, one at each end extending from the top 18 to just above the bottom edge of sidewall 20. The top 18 has a plurality of sound transmitting orifices 26 and the inner surface of the top wall 18 has an integrally formed speaker frame 28 for receiving a speaker 30 and speaker wires 32, as more fully described below. As usual, speaker 30 comprises a speaker cone 31 and a magnet 33. Also integrally formed with the upper section 14 is a battery support wall 34 which depends from the top wall 18 parallel to sidewall 20. As shown, top wall 18 also has a hole 35 to accommodate the insertion of a narrow strip of insulating material 36 which functions as a battery disconnect mechanism for conserving battery life during assembly and storage, as more fully described below.

The lower section 16 of the casing 12 is dimensioned for a snug fit in upper section 14. As shown, lower section 16 has a flat bottom 38 and a sidewall 40 extending upward from the bottom 38. Two sides of the sidewall 40 have integrally formed hooks 44 thereon for alignment with channels 24 when the device is assembled.

Extending upward from the bottom wall 38 of lower section 16 are two diagonally opposing pegs 46 and a pair of diagonally opposing posts 48. The lower section 16 also includes a battery chamber 50 defined by integral walls 52 and 54, the walls 54 supporting battery contacts 56. The inside surface of the bottom wall 38 also has an integrally formed switch brace 58 for seating rubber dome-switch 66, as more fully described below.

Figure 5:
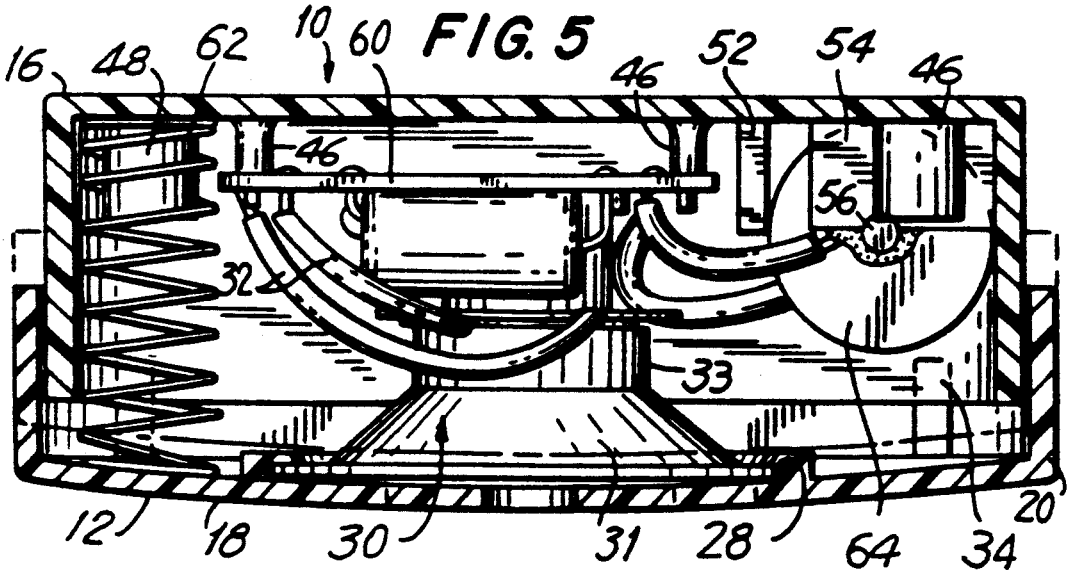
FIG. 5 is a cross-sectional view substantially along line 5—5 of FIG. 2.
Figure 6:
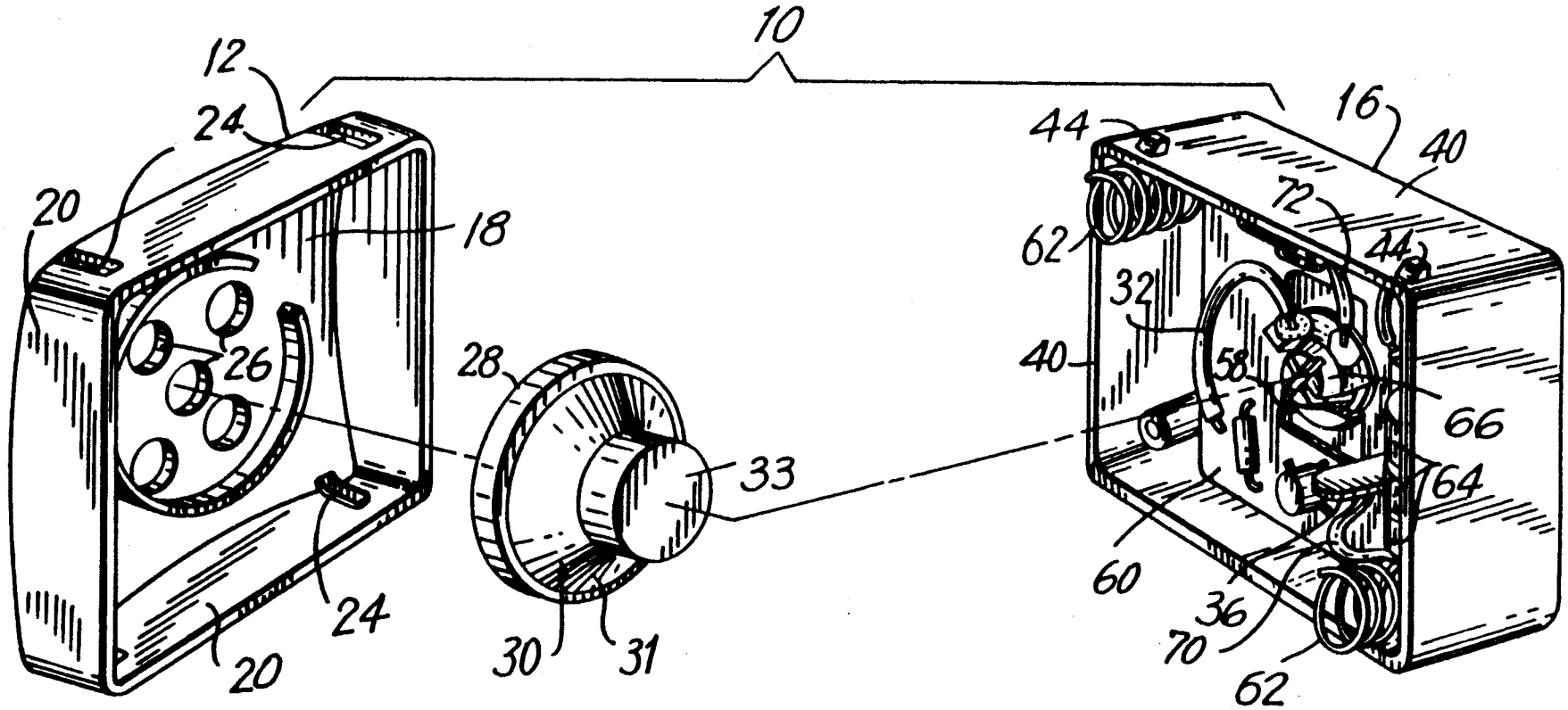
FIG. 6 is an exploded view of the squeeze switch device in accordance with the present invention.

As shown in FIGS. 3–6, the device 10 also comprises a circuit board 60, two diagonally opposing springs 62 seated about the posts 48, three battery cells 64, and a rubber dome-switch 66. The circuit board 60 has two openings 68 with ground lead 70 and circuit lead 72 exposed therebetween on circuit board 60. As also shown, circuit board 60 has two diagonally opposed holes 74 which seat about pegs 46 for securing the circuit board 60 to the bottom 38.

With circuit board 60 in place, switch brace 58 protrudes through openings 68 for positioning the conductive portion of the rubber dome-switch 66 directly above ground lead 70 and circuit lead 72. As more fully described below, when the dome-switch 66 is pushed down, it shorts ground lead 70 to circuit lead 72, thus activating the circuit.

Referring now to FIGS. 2–6, the operation of the device will now be described. Speaker 30 is seated in speaker frame 28 with the speaker cone 31 facing orifices 26. Speaker 30 is connected to circuit board 60 by speaker wires 32 for transmitting electrical signals from circuit board 60 to the speaker. When the device 10 is assembled, hooks 44 are aligned with and seat in channels 24 and the speaker magnet 33 is positioned in close spaced relation above rubber dome-switch 66. Springs 62 bias upper section 14 away from lower section 16 such that, when the device is in its static state, the hooks 44 seat at the bottom of channels 24.

The device is activated by applying squeezing pressure to the casing 12 thereby compressing the springs 62 for moving speaker magnet 33 into contact with rubber dome-switch 66 thus pushing the dome-switch into contact with the contacts 70, 72. As is well known to those or ordinary skill in the art, when the conductor portion of rubber dome-switch 66 comes in contact with ground lead 70 and circuit lead 72, the latter is shorted to ground thus activating the circuit on circuit board 60. Upon activation, a micro chip (not shown) in the circuit generates an electrical signal corresponding to a sound which is outputted to speaker 30 via speaker wires 32.

Referring to FIG. 1, in a preferred embodiment the device is enclosed within a stuffed toy animal 11 which, when squeezed, generates a sound commonly associated with the appearance of the animal. By utilizing the combination of hooks 44 and channels 24 to movably secure upper section 14 to lower section 16, and by utilizing two diagonally opposing springs 62 to bias upper portion 14 away from lower portion 16, the device 10 can be easily activated by squeezing the stuffed toy animal in any one of a plurality of directions. In this regard, the hooks and channels 24 ensure that, at all times, upper portion 14 remains secured to lower portion 16 with speaker magnet 33 in spaced relation directly above rubber dome switch 66.

Since device 10 is typically enclosed in a stuffed toy animal incorporating a stitched seam as opposed to a zippered seam, battery replacement is not practical. Accordingly, and given the limited life of battery cells, it is highly desirable to reduce battery drain as much as possible during device assembly, storage and shipping, i.e. before the devices are incorporated in stuffed toy animals.

Battery drain during device assembly, storage and shipping can occur from the devices being accidentally activated when handled. Since the devices are easily activated by applying a pushing or squeezing pressure, they may be frequently activated when, for example, in their unincorporated state they are stacked for storage or shipped in bulk. Another source of battery drain is quiescent current flow from the battery cells through the micro chip.

The present invention reduces battery drain by utilizing an easily removable insulating strip 36 which is accessible after assembly of device 10 is complete. As shown, and as noted above, the device 10 has a hole 35 in upper section 14 positioned directly above the point of abutment of two of the battery cells 64. In this way, the insulating strip 36 may be inserted through hole 35 into the space between said two abutting batteries 64, thus preventing unintended circuit activation and blocking quiescent current flow. In this way, the devices may be stacked, stored and shipped with only minimal loss of battery life. When the devices 10 are to be incorporated in the plush toys, the insulating strip 36 is simply pulled out through the hole 35 whereupon the device 10 is ready for use.

The circuit on circuit board 60 also employs reset means to help conserve battery life. Thus, when a stuffed toy animal incorporating the device 10 is squeezed, thus activating the device and generating a sound, the device can only be reactivated by releasing the toy and reapplying a squeezing pressure.

Although I have herein shown and described the preferred embodiment of the invention, various changes and modifications will be readily apparent to those of ordinary skill in the art who read the foregoing description. For example, instead of a speaker, a light or motion generating load, such as a light bulb or vibrator, respectively, may be used and the circuit on circuit board 60 modified accordingly to drive said load. Therefore, the foregoing description should be construed as illustrative, and not in a limiting sense, the scope of the invention being defined by the following claims.

I claim:

1. A device for use in plush toys wherein the device comprises:

a circuit for generating sound, light or motion comprising:

(a) means for generating an electrical signal corresponding to said sound, light or motion and incorporating a push switch for activating said circuit means;

(b) load means for generating said sound, light or motion when excited by said electrical signal;

(c) electrical conducting means for conducting said electrical signal from said circuit means to said load means for driving said load means;

housing means for said sound-generating mechanism comprising two sections;

means for securing said two sections together for relative movement between a first position wherein said two sections are spaced apart by a first predetermined distance and a second position wherein said sections are spaced apart by a second distance less than said first predetermined distance;

said push switch being secured to one of said two-sections and said load means being secured to said other section in alignment with said push switch for activating same when said sections are in said second position; and means for biasing said two sections to said first position and for accommodating movement of said two sections to said second position when said two sections are squeezed together.

2. The device of claim 1, wherein said means for generating an electrical signal comprises a micro chip and battery means for powering said micro chip.

3. The device of claim 2, further comprising an insulating member disposed in said circuit for interrupting quiescent current flow from said battery means, said housing including a hole for accommodating disposal and removal of said insulating member from said generating circuit, said insulating member being removed from said hole prior to incorporating said device in a plush toy.

4. The device of claim 3, wherein said battery means comprises a plurality of batteries and wherein said insulating member is disposed between two of said batteries.

5. The device of claim 3, wherein said biasing means comprises at least one spring, one end of said spring abutting one of said sections and the other end of said spring abutting the other of said sections.

6. A device for use in plush toys wherein the device comprises:

a circuit for generating sound comprising:

(a) means for generating an electrical signal corresponding to said sound and incorporating a push switch for activating said circuit means;

(b) speaker means having a sound generating member for generating said sound when excited by said electrical signal;

(c) electrical conducting means for conducting said electrical signal from said circuit means to said speaker means for driving said speaker means;

housing means for said circuit comprising two sections and including a wall having at least one aperture therein positioned in confronting relation to said sound generating member;

means for securing said two sections together for relative movement between a first position wherein said two sections are spaced apart by a first predetermined distance and a second position wherein said sections are spaced apart by a second distance less than said first predetermined distance, said securing means comprising at least one slot in one of said sections and at least one protrusion on the other of said section, and wherein said protrusions seat in said slots for movement therein during relative movement of said sections;

said push switch being secured to one of said sections and said speaker means being secured to the other of said sections in alignment with said push switch for activating said push switch when said sections are moved to said second position; and means for biasing said two sections to said first position and for accommodating movement of said two sections to said second position when said two sections are squeezed together.

* * * * *